United States Patent [19]

Harmison, Jr.

[11] 4,413,488

[45] Nov. 8, 1983

[54] ELECTRICAL APPLIANCE LOCK

[75] Inventor: Herbert A. Harmison, Jr., Ames, Iowa

[73] Assignee: Iowa State University Research Foundation, Inc., Ames, Iowa

[21] Appl. No.: 219,371

[22] Filed: Dec. 22, 1980

[51] Int. Cl.[3] ..... E05B 65/00

[52] U.S. Cl. ..... 70/57; 339/37

[58] Field of Search ..... 70/57, 58, 14, 61; 339/37

[56] References Cited

U.S. PATENT DOCUMENTS

| | | | |
|---|---|---|---|
| 2,654,073 | 9/1953 | Katz | 339/37 |
| 2,733,416 | 1/1956 | Evalt | 339/37 |
| 3,345,600 | 10/1967 | Scherer | 339/37 |
| 3,416,123 | 12/1968 | Husebo | 339/37 |
| 3,422,389 | 1/1969 | Husebo | 339/37 |
| 3,662,320 | 5/1972 | Marx | 339/37 |

*Primary Examiner*—Robert L. Wolfe

*Attorney, Agent, or Firm*—Zarley, McKee, Thomte, Voorhees & Sease

[57] ABSTRACT

An electrical appliance lock comprising a first portion having an opening formed therein for receiving the shackle of a conventional padlock and having an elongated member secured thereto at one side thereof and extending therefrom. The elongated member is adapted to extend through the opening in at least two prongs of the electrical appliance plug, which are positioned on opposite sides of the shackle. A modified form of the lock is also described wherein the elongated member has a U-shaped portion at one end thereof which is secured to the shackle-engaging portion.

5 Claims, 5 Drawing Figures

ELECTRICAL APPLIANCE LOCK

BACKGROUND OF THE INVENTION

This invention relates to an electrical appliance lock and more particularly to a locking device which may be secured to the plug of the electrical appliance to prevent unauthorized use of the appliance.

It is sometimes desirable to prevent the unauthorized use of an electrical appliance. For example, a child could be possibly injured if allowed to insert the plug of an electrical appliance, such as an electric drill, saw, trimmer, etc., into an electrical outlet. It is also sometimes desirable to prevent unauthorized use of tools or the like left at the owner's place of employment.

Many types of electrical plug locking devices have been previously described but the typical devices are extremely complicated and difficult to manufacture as well as difficult to use. Therefore, it is a principal object of the invention to provide an improved electrical appliance lock.

A still further object of the invention is to provide an electrical appliance lock which is extremely inexpensive to manufacture and which is easy to use.

A further object of the invention is to provide an electrical appliance lock which may be positioned on a conventional padlock to prevent the unauthorized use of the appliance.

A still further object of the invention is to provide an electrical appliance lock which accommodates a plurality of electrical plugs.

These and other objects will be apparent to those skilled in the art.

SUMMARY OF THE INVENTION

An electrical appliance lock is disclosed comprising a substantially flat support means having an opening formed therein which is adapted to receive the shackle of a conventional padlock. An elongated member is secured to the support means at one side thereof and extends therefrom. The elongated member is adapted to extend through the openings in at least two prongs of an electrical appliance plug which are positioned on opposite sides of the shackle. A modified form of the invention is also disclosed and includes a substantially flat support means having an opening formed for receiving the shackle of a conventional padlock. An elongated member is also provided and has a U-shaped portion at one end thereof which is secured to the support means. Both locking devices may be used to secure one or more electrical appliance plugs thereto to prevent the unauthorized use of the appliance.

DESCRIPTION OF THE PREFERRED EMBODIMENT

Figure 1:
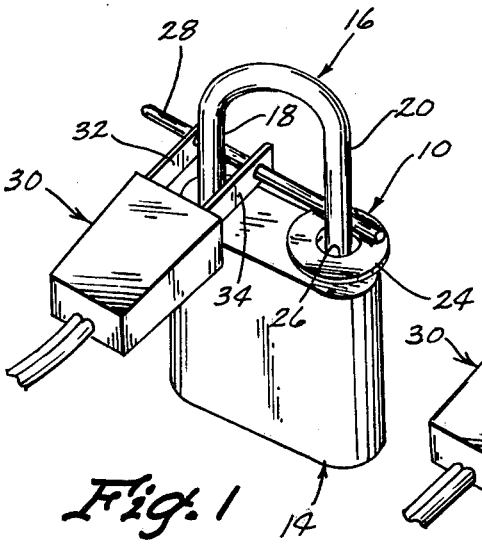
FIG. 1 is a perspective view of one form of the lock mounted on a conventional padlock.
Figure 3:
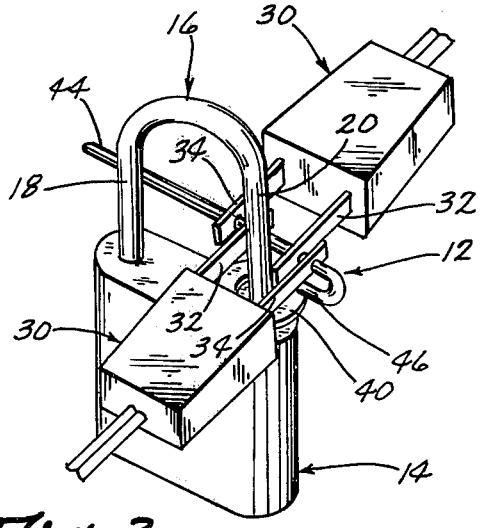
FIG. 3 is a perspective view illustrating a modified form of the locking device being used to lock a pair of electrical plugs.
Figure 4:
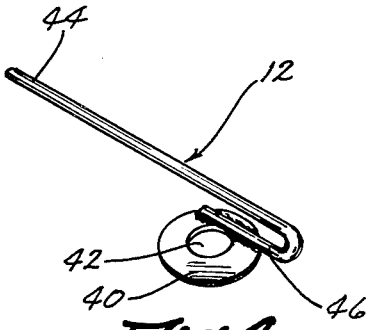
FIG. 4 is a perspective view of the modified form of the locking device.
Figure 5:
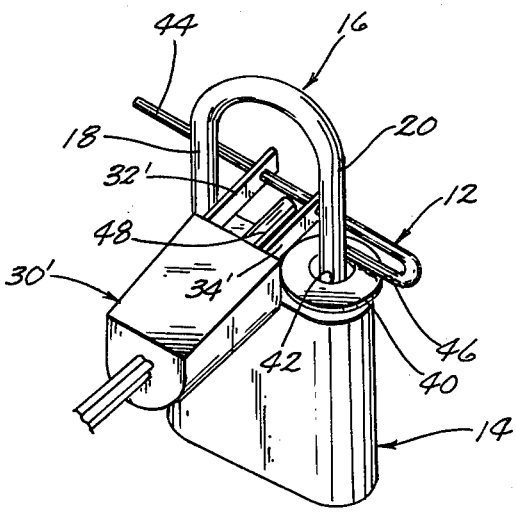
FIG. 5 is a perspective view similar to FIG. 3 except that the modified form of the invention is illustrated in combination with a grounded plug.

The preferred embodiment of the locking device is illustrated in FIG. 1 and is generally designated by the reference numeral 10 while a modified form of the invention is illustrated in FIGS. 3–5 and is designated by the reference numeral 12. A conventional padlock 14 is used in combination with the locking devices and includes a U-shaped shackle 16 including leg portions 18 and 20. Leg portion 20 is adapted to be received by the opening 22 in the padlock 14 in conventional fashion.

Figure 2:
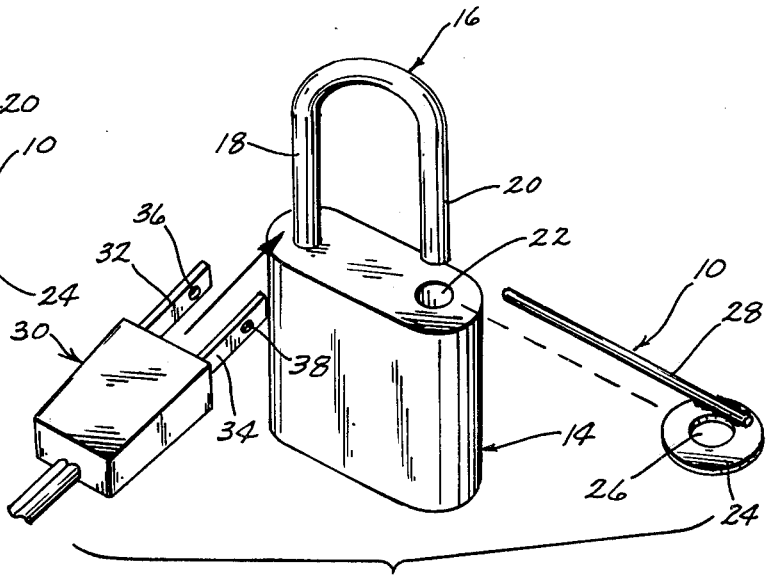
FIG. 2 is a perspective view illustrating the manner of attaching the lock of FIG. 1 to the padlock and plug.

Locking device 10 includes a substantially flat support means 24 having an opening 26 formed therein. The support means 24 is illustrated as being of the washer configuration but it should be understood that the support means 24 could have other configurations. For example, it is conceivable that the support means 24 could be square or rectangular. An elongated member 28 is secured to support means 24 outwardly of the opening 26 and extends therefrom as seen in FIGS. 1 and 2. Member 28 could be integral with support means 24 if desired.

The locking device 10 is adapted to be secured to an electrical appliance plug 30 having prongs 32 and 34. Prongs 32 and 34 are provided with conventional openings 36 and 38 formed therein respectively. The plug 30 is secured to the padlock 14 and the locking device 10 as follows. Plug 30 is moved so that leg portion 18 of shackle 16 is received between the prongs 32 and 34 as illustrated in FIG. 1. Locking device 10 is then maneuvered so that the elongated member 28 is extended through the openings 38 and 36 and so that the opening 26 is positioned directly above the opening 22. Shackle 16 is then moved downwardly into its locked position so that the components are positioned as illustrated in FIG. 1. As seen in FIG. 1, the plug 30 cannot be removed from the padlock 14 until the padlock 14 is unlocked. Thus, the padlock 14 and the locking device 10 prevent the unauthorized use of the appliance associated with the plug 30.

Referring to the embodiment of the locking device illustrated in FIGS. 3–5, the numeral 40 refers to a substantially flat support means having a central opening 42 formed therein which is adapted to receive the shackle 16 identically to that previously described. An elongated member 44 is also provided and is generally similar to elongated member 28 except that a U-shaped portion 46 is provided at one end of the elongated member 44. U-shaped portion 46 is secured to the support means 40 by any conventional means such as welding or the like as illustrated in FIG. 4. Locking device 12 performs substantially the same function as locking device 10 except that the elongated member 44 dwells in a plane somewhat above that of the support means 40. It has been found that the locking device 12 is somewhat easier to use when a plurality of electrical plugs is being secured to the padlock 14. FIG. 3 illustrates a pair of electrical plugs 30 being secured to the padlock 14. As seen in FIG. 3, the elongated member 44 is extended through the openings in the prongs extending from the plug to secure the same. FIG. 5 illustrates the locking device 12 being employed to secure a grounded plug 30' to the padlock 14. Grounded plug 30' includes prongs 32' and 34' as well as the grounding prong 48. It has been found that the most convenient manner of securing a grounded plug 30' to the padlock 14 is that illustrated in FIG. 5. The prongs 32', 34' and 48 are positioned between the leg portions of the shackle 16 with the elongated member 44 being received by the openings in the prongs 32' and 34'.

Thus it can be seen that the locking devices herein described are extremely simple and are very economical to manufacture. The locking devices described herein are very simple to use and do not permit the unauthorized use of the electrical appliance. It can therefore be seen that the locking device of this invention accomplishes at least all of its stated objectives.

I claim:

1. A locking device for an electrical appliance plug, comprising, a shackle engaging portion having an opening formed therein for receiving a padlock shackle comprising a U-shaped portion, said shackle engaging portion having an elongated member extending therefrom adapted to extend through the openings in at least two prongs of the plug, said elongated member and said plug being positioned on opposite sides of the shackle with at least one of said prongs extending through said U-shaped portion of said shackle.

2. The locking device of claim 1 wherein said shackle engaging portion comprises a substantially flat support means.

3. The locking device of claim 2 wherein said elongated member is secured to said support means at one side thereof.

4. The locking device of claim 1 wherein said elongated member is positioned at one side of the shackle and wherein the plug is positioned on the other side of the shackle with the shackle being received between the prongs of the plug so that the openings in the prongs are positioned on the same side of the shackle as the elongated member.

5. The locking device of claim 3 wherein said elongated member has a U-shaped portion at one end thereof which is secured to said support means so that said elongated member dwells in a plane spaced from said support means.

* * * * *